US009352593B2

(12) United States Patent
Hata et al.

(10) Patent No.: US 9,352,593 B2
(45) Date of Patent: May 31, 2016

(54) IMAGE FORMING APPARATUS

(71) Applicant: Konica Minolta, Inc., Chiyoda-ku (JP)

(72) Inventors: Masaki Hata, Nagoya (JP); Kiyomitsu Koyama, Toyokawa (JP); Osamu Akiyama, Tama (JP); Hiroshi Mizuno, Aisai (JP); Yasuaki Tomoda, Toyohashi (JP); Naoki Nonoyama, Toyokawa (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 14/132,929

(22) Filed: Dec. 18, 2013

(65) Prior Publication Data

US 2014/0169822 A1 Jun. 19, 2014

(30) Foreign Application Priority Data

Dec. 19, 2012 (JP) ..... 2012-277081

(51) Int. Cl.

| | |
|---|---|
| ***B41J 29/02*** | (2006.01) |
| ***B41J 13/10*** | (2006.01) |
| ***B41J 3/46*** | (2006.01) |

(52) U.S. Cl.

CPC . *B41J 13/106* (2013.01); *B41J 3/46* (2013.01)

(58) Field of Classification Search

CPC ..... B41J 3/46
USPC ..... 400/693
See application file for complete search history.

(56) References Cited

U.S. PATENT DOCUMENTS

| | | | | |
|---|---|---|---|---|
| 6,750,979 | B1 * | 6/2004 | Kobayashi | B41J 3/445 348/207.2 |
| 6,752,554 | B1 * | 6/2004 | Brittingham | 400/693 |
| 6,848,850 | B2 * | 2/2005 | Matsuo | B41J 29/023 347/108 |
| 7,182,534 | B2 * | 2/2007 | Proulx et al. | 400/693 |
| 7,535,599 | B2 * | 5/2009 | Silverbrook | B41J 2/01 358/1.1 |
| 7,887,245 | B1 * | 2/2011 | Hawkins | 400/76 |
| 7,912,418 | B2 * | 3/2011 | Hattori et al. | 399/405 |
| 8,184,996 | B2 * | 5/2012 | Andou | 399/11 |

(Continued)

FOREIGN PATENT DOCUMENTS

| | | |
|---|---|---|
| JP | 03-132814 A | 6/1991 |
| JP | 08-081109 A | 3/1996 |

(Continued)

OTHER PUBLICATIONS

Office Action issued on Dec. 16, 2014, by the Japanese Patent Office in corresponding Japanese Patent Application No. 2012-277081, and an English translation of the Office Action. (5 pages).

(Continued)

*Primary Examiner* — Anthony Nguyen
(74) *Attorney, Agent, or Firm* — Buchanan Ingersoll & Rooney PC

(57) ABSTRACT

An image forming apparatus including: a housing; a display whose display surface is provided on a front-surface side of the housing; an image forming unit provided in the housing and configured to form an image on a recording sheet; and an ejector configured to eject the recording sheet with the image formed thereon from inside to outside of the housing in a direction approaching the display surface.

19 Claims, 14 Drawing Sheets

(56) References Cited

U.S. PATENT DOCUMENTS

| | | | | |
|---|---|---|---|---|
| 8,449,107 | B2 * | 5/2013 | Kawabata | B41J 13/10 347/101 |
| 8,528,897 | B2 * | 9/2013 | Takeshita | B41J 13/106 271/207 |
| 2002/0141806 | A1 * | 10/2002 | Endo | B41J 25/02 400/693 |
| 2006/0023006 | A1 * | 2/2006 | Sawai | B41J 3/46 347/2 |
| 2006/0024094 | A1 * | 2/2006 | Uehara | 399/299 |
| 2006/0024116 | A1 * | 2/2006 | King et al. | 400/624 |
| 2006/0071413 | A1 * | 4/2006 | Kaneko et al. | 271/220 |
| 2006/0221170 | A1 * | 10/2006 | Sato et al. | 347/138 |
| 2008/0315514 | A1 | 12/2008 | Iguchi et al. | |

FOREIGN PATENT DOCUMENTS

| | | | |
|---|---|---|---|
| JP | 2003-145896 | A | 5/2003 |
| JP | 2005-044018 | A | 2/2005 |
| JP | 2009-001426 | A | 1/2009 |
| JP | 2009-206693 | A | 9/2009 |
| JP | 2009-298561 | A | 12/2009 |
| JP | D1391296 | S | 6/2010 |

OTHER PUBLICATIONS

Office Action (Decision to Grant a Patent) issued on Jul. 14, 2015, by the Japanese Patent Office in corresponding Japanese Patent Application No. 2012-277081, and an English Translation of the Office Action. (3 pages).

* cited by examiner

IMAGE FORMING APPARATUS

CROSS-REFERENCE TO RELATED APPLICATIONS

This application is based on application No. 2012-277081 filed in Japan, the contents of which are hereby incorporated by reference.

BACKGROUND OF THE INVENTION (1) Field of the Invention

The present invention relates to an image forming apparatus having a display and a printer as one unit.

(2) Description of the Related Art

In recent years, a printer with a display has been used in various shops such as convenience stores, supermarkets and travel agencies. The printer with a display can display an image to be printed on the display, and output a recording sheet with the image printed thereon.

The printer has a function to obtain a desired print-target image from a network such as the Internet, to which the printer is connected, and display the obtained image on the display, and a function to store service information (for example, introduction of new products, information on events or new movies, recipes, or surrounding map), which is supplied to users as a service, in advance in a memory or the like, and display the service information on the display.

FIG. 14 illustrates a specific example of a printer with a display (see Japanese design registration No. 1391296). In the printer illustrated in FIG. 14, a touch panel is attached to a display 1401, and the user can instruct the printer to display a desired image on the display 1401 and output a recording sheet with the image printed thereon from an outlet 1402 by inputting instructions into the printer via the touch panel.

However, the above-described printer with a display has a problem that, since it does not include a paper tray and an outlet is provided below the display, if a recording sheet with an image printed thereon is ejected while the user is seeing the display screen in front of the printer, the user may not recognize the ejection of the recording sheet, and the recording sheet may drop onto the floor and be smeared. Furthermore, since the recording sheet is ejected forward of the printer, the ejected recording sheet may collide with the body of the user standing in front of the printer, and be bent.

In view of this problem, a paper tray may be provided to prevent the recording sheet from falling onto the floor. However, since the paper tray would stick out from the front of the printer, it would be an obstruction to the user operating the display, thereby impairing the operability.

SUMMARY OF THE INVENTION

In view of the above-described problem, according to one embodiment of the present invention, there is provided an image forming apparatus comprising: a housing; a display whose display surface is provided on a front-surface side of the housing; an image forming unit provided in the housing and configured to form an image on a recording sheet; and an ejector configured to eject the recording sheet with the image formed thereon from inside to outside of the housing in a direction approaching the display surface.

BRIEF DESCRIPTION OF THE DRAWINGS

These and the other objects, advantages and features of the invention will become apparent from the following description thereof taken in conjunction with the accompanying drawings which illustrate a specific embodiment of the invention. In the drawings.

DESCRIPTION OF EMBODIMENTS

The following describes an embodiment of the image forming apparatus of the present invention, taking as an example a case where the present invention is applied to a tandem color digital printer (hereinafter, merely referred to as a "printer") of a floor type that is placed on the floor.

[1] Structure of Printer

Figure 1:
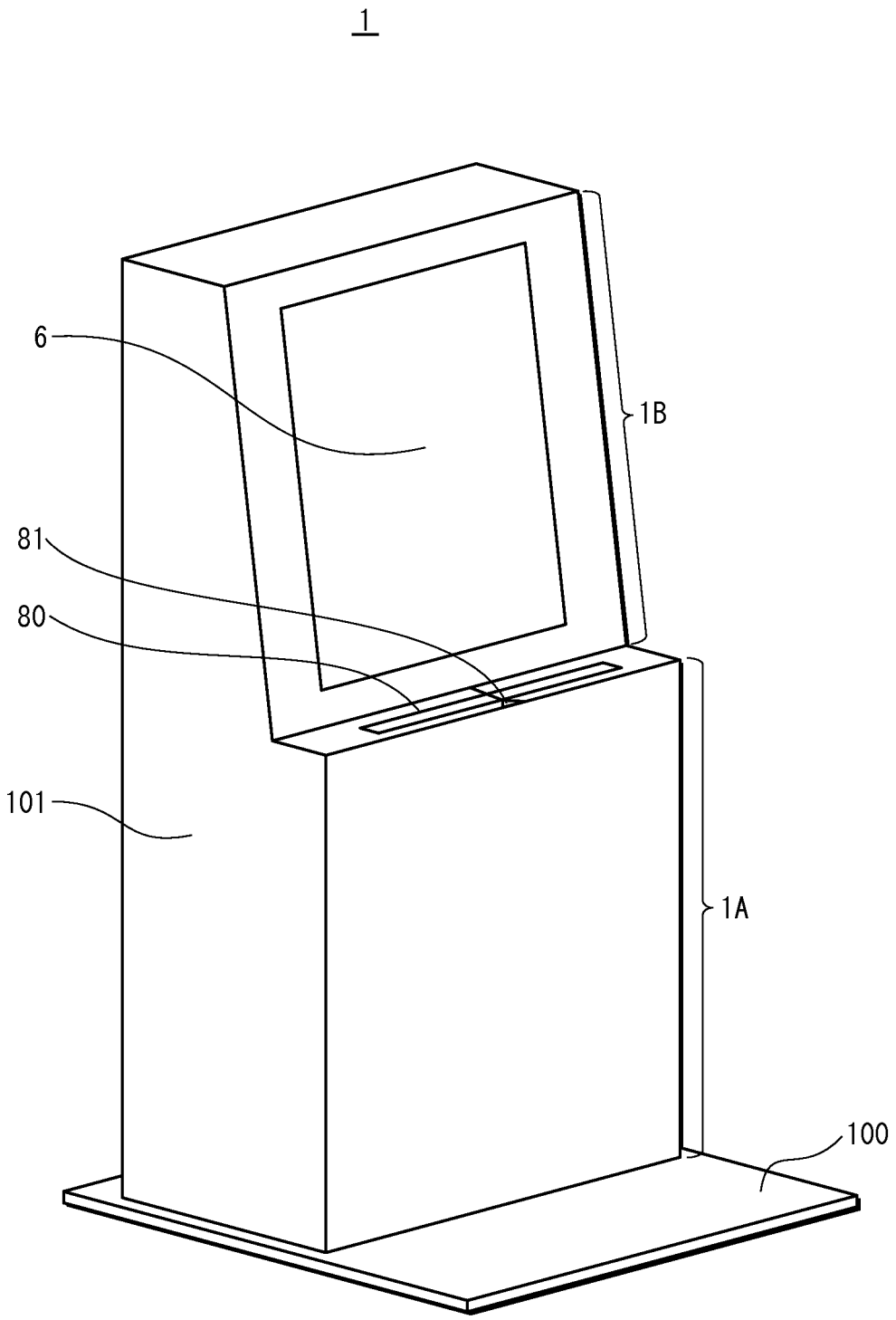
FIG. 1 is a perspective view illustrating an overall structure of a printer.

First the structure of the printer is explained. FIG. 1 is a perspective view illustrating an overall structure of a printer 1. As illustrated in FIG. 1, the printer 1 is composed of a housing 101 and a bottom plate 100, wherein the housing 101 is fixed on the bottom plate 100 that is placed on the floor. The housing 101 of the printer 1 is composed of a body part 1A and a display part 1B. The body part 1A includes an image forming unit for forming a thermally fixed image on a recording sheet. The display part 1B includes a liquid crystal display device 6 whose display surface with a touch panel is provided on a front-surface side of the housing 101. The display part 1B performs such processes as controlling image display and receiving instructions from the user.

The top surface of the body part 1A has an outlet 80 for a recording sheet, on which a thermally fixed image has been formed, to be ejected from inside to outside of the housing 101. The outlet 80 is provided with an outlet sensor 81 that is a photo sensor for detecting whether or not a recording sheet is present in the outlet 80.

Figure 2:
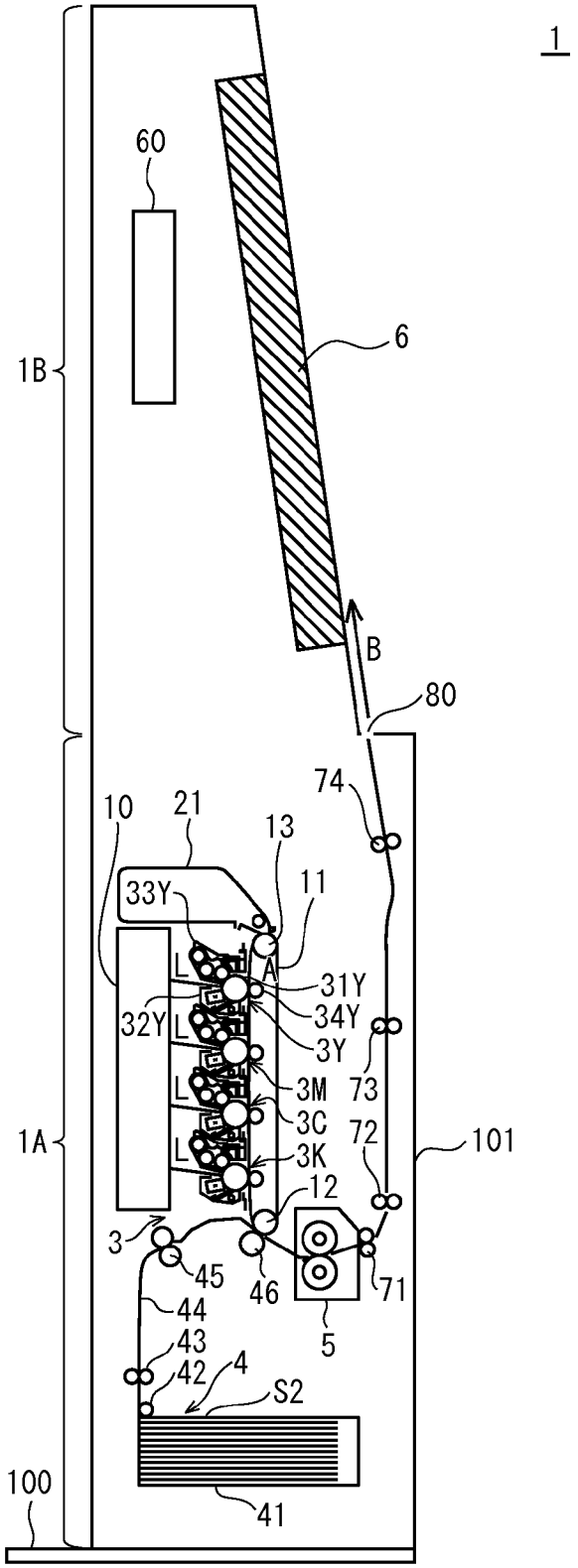
FIG. 2 is a cross-sectional view illustrating the structure of the printer.

FIG. 2 is a cross-sectional view illustrating the structure of the printer 1. As illustrated in FIG. 2, the printer 1 includes an image processor 3, a sheet feeder 4, a fixing device 5, and a controller 60. In this example, the image forming unit includes the image processor 3, the sheet feeder 4, and the fixing device 5, and the display part 1B includes the controller 60 and the liquid crystal display device 6.

The printer 1 is connected to a network (for example, the Internet) and receives a print instruction through the touch panel formed on the display surface of the liquid crystal display device 6. Based on the print instruction, the printer 1 executes a print process by forming toner images of yellow, magenta, cyan, and black, forming a full-color image by transferring the toner images of the colors onto a recording sheet by a multi-transfer, and thermally fixing the full-color image onto a recording sheet. Hereinafter, the reproduction colors yellow, magenta, cyan, and black are represented as Y, M, C, and K, respectively, and the Y, M, C, and K will be added to the reference numbers of the elements related to the colors, The image processor 3 includes image creating units 3Y, 3M, 3C and 3K, an exposing unit 10, an intermediate transfer belt 11, and a second transfer roller 46. The image creating units 3Y, 3M, 3C and 3K have similar structures. Thus in the following, the structure of the image creating unit 3Y is explained mainly.

The image creating unit 3Y includes a photosensitive drum 31Y and, provided around the photosensitive drum 31Y, a charger 32Y, a developing unit 33Y, and a first transfer roller 34Y, and creates a toner image of color Y on the photosensitive drum 31Y. The developing unit 33Y is provided to face the photosensitive drum 31Y, and transports electrically charged toner to the photosensitive drum 31Y. The intermediate transfer belt 11, an endless belt, is suspended with tension between a drive roller 12 and a passive roller 13 and is caused to move cyclically in the direction indicated by the arrow A in the drawing. A cleaner 21 for removing the toner that has remained on the intermediate transfer belt 11 is provided in the vicinity of the passive roller 13.

The exposing unit 10 is provided with light-emitting elements such as laser diodes, and emits laser beams L to scan the photosensitive drums of the image creating units 3Y, 3M, 3C and 3K with the emitted laser beams, thereby creating images of colors Y-K in accordance with a drive signal received from the controller 60. With this scanning, an electrostatic latent image is formed on the surface of the photosensitive drum 31Y that has been electrically charged by the charger 32Y. Similarly, electrostatic latent images are formed on the surfaces of the photosensitive drums of the image creating units 3M, 3C and 3K.

The electrostatic latent images formed on the surfaces of the photosensitive drums are developed by the developing units of the image creating units 3Y, 3M, 3C and 3K, so that toner images of corresponding colors are formed on the photosensitive drums. The toner images thus formed are transferred onto the intermediate transfer belt 11 by the first transfer rollers (in FIG. 2, only the sign 34Y denoting the first transfer roller corresponding to the image creating unit 3Y is illustrated, and signs denoting the other first transfer rollers are omitted) of the image creating units 3Y, 3M, 3C and 3K, wherein the toner images are transferred one by one at different timing so that the images are superimposed at the same position on the intermediate transfer belt 11, this transfer being referred to as a first transfer. The toner images on the intermediate transfer belt 11 are transferred onto a recording sheet at once by the electrostatic action of the second transfer roller 46, this transfer being referred to as a second transfer, The recording sheet with the toner image transferred thereon by the second transfer is transported to the fixing device 5. The fixing device 5 thermally fixes the toner image (unfixed image) onto the recording sheet by heating and pressing the sheet. The recording sheet is then transported upward (in the direction toward the outlet 80) by transport roller pairs 71, 72 and 73, and ejected by an ejection roller pair 74 from the outlet 80 along the display surface of the liquid crystal display device 6 as indicated by the arrow B in FIG. 2.

Figure 3A:
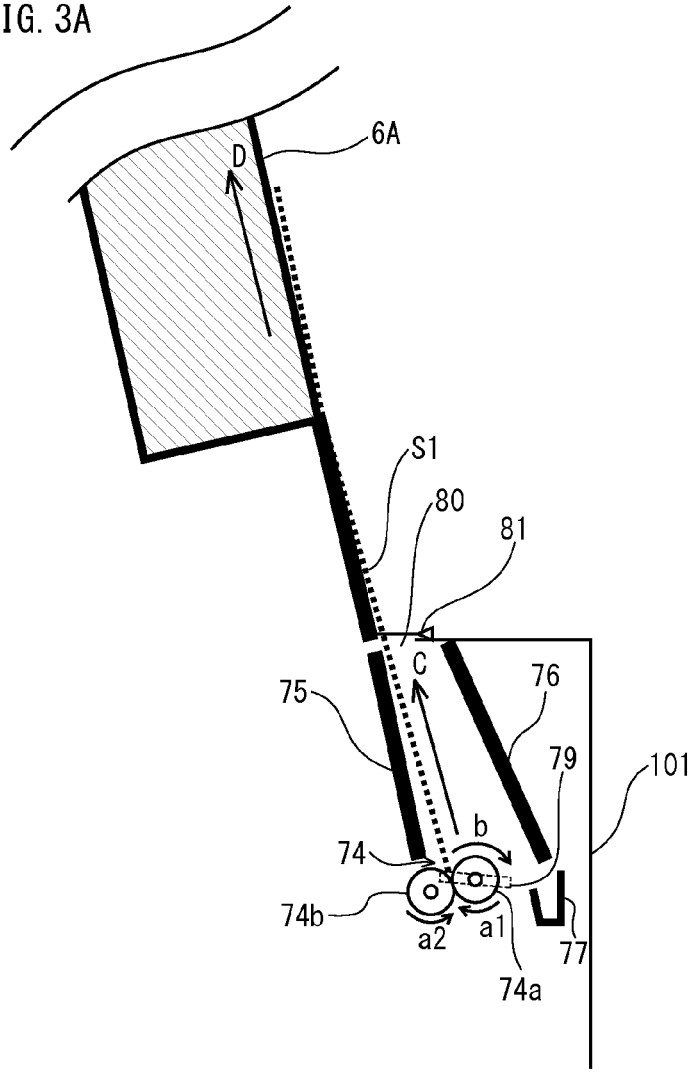
FIG. 3A is a cross-sectional view illustrating the details of the periphery of the ejection roller pair.

FIG. 3A is a cross-sectional view illustrating the details of the periphery of the ejection roller pair 74. In FIG. 3A, sign 74 represents the ejection roller pair, signs 74*a* and 74*b* respectively represent ejection rollers that make the ejection roller pair, signs 75 and 76 represent paper ejection guides, sign 77 represents a stocker for holding the rear end of the recording sheet, sign 79 represents a rear end movement assisting member for assisting the rear end of the recording sheet to move to the stocker 77 when the rear end is released from the ejection roller pair 74, sign 80 represents the outlet, sign 81 represents the outlet sensor, sign 6A represents the display surface of the liquid crystal display device 6, and sign 101 represents the housing. Furthermore, sign S1 in FIG. 3A represents the recording sheet on which an image has been formed, and signs a1 and a2 represent rotation directions of the ejection rollers 74*a* and 74*b*, respectively.

Figure 3B:
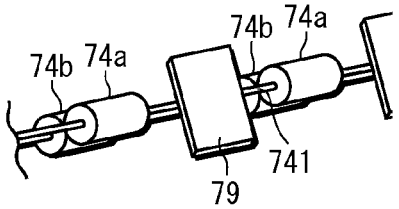
FIG. 3B is a perspective view illustrating the rear end movement assisting member.

As illustrated in FIG. 3B, the rear end movement assisting member 79 is fixedly attached to a rotating shaft 741 of the ejection roller 74*a*, which is closer to the stocker 77 than the ejection roller 74*b*, and rotates in the same direction as the rotational direction of the ejection roller 74*a*, with the rotation of the ejection roller 74*a*.

The rear end movement assisting member 79 rotates in contact with the main surface of the recording sheet S1 that is on the ejection roller 74*a* side while the recording sheet S1 is passing through the ejection roller pair 74, and after the recording sheet S1 is released from the ejection roller pair 74, rotates in contact with the main surface of the recording sheet S1 that is on the ejection roller 74*b* side, and assists the rear end of the recording sheet S1 to move, in the direction indicated by the arrow "b" in FIG. 3A, along the circumferential surface of the ejection roller 74*a* into the stocker 77. The rear end movement assisting member 79 is formed from a sponge material (for example, chloroprene sponge) that is flexible or cushioning to protect the recording sheet S1 from a damage caused by the contact therewith.

Back to the explanation with reference to FIG. 3A, the recording sheet S1 is ejected by the ejection roller pair 74 in a direction in which the recording sheet S1 approaches the display surface 6A of the liquid crystal display device 6 as indicated by the arrow C, thereby the recording sheet S1 is ejected via the outlet 80 along the display surface 6A. After the rear end of the recording sheet S1 is released from the ejection roller pair 74, the main surface of the recording sheet S1 that is on the ejection roller 74*b* side is pushed by the rear end movement assisting member 79, and the rear end of the recording sheet S1 is moved in the arrow "b" direction into the stocker 77 and is held therein. At this time, the tip of the recording sheet S1 is supported by the display surface 6A of the liquid crystal display device 6.

Figure 3C:
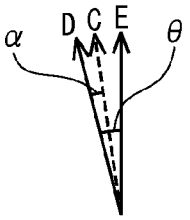
FIG. 3C is a diagram for explaining the direction in which the recording sheet is ejected.

Note that the "direction in which the recording sheet S1 approaches the display surface 6A of the liquid crystal display device 6" refers to a direction in a range where an inclination angle α is not more than an inclination angle θ as illustrated in FIG. 3C, the inclination angle α being made between the display surface 6A of the liquid crystal display device 6 (the direction indicated by the arrow D) and the direction in which the recording sheet is ejected by the ejection roller pair 74 (the direction indicated by the arrow C), and the inclination angle θ being made between the display surface 6A of the liquid crystal display device 6 and the vertical direction (the direction indicated by the arrow E).

Back to the explanation with reference to FIG. 2, the sheet feeder 4 includes a sheet feed cassette 41 for holding recording sheets (denoted by sign S2 in FIG. 2), a feed roller 42 for feeding the recording sheets one by one from the sheet feed cassette 41 onto a transport path 44, a transport roller pair 43 for transporting the recording sheet S2 having been fed onto the transport path 44 to a timing roller pair 45, and the timing roller pair 45 for transporting the recording sheet S2 to a second transfer position at appropriate timing.

A plurality of sheet feed cassettes may be provided, not limited to one. As the recording sheets, paper sheets of various sizes and thicknesses (regular paper, thick paper, etc.) and film sheets such as OHP sheets can be used. When a plurality of sheet feed cassettes are provided, recording sheets that are different in size, thickness, or material may be housed in the plurality of sheet feed cassettes.

The timing roller pair 45 transports each recording sheet to the second transfer position at a timing that corresponds to the timing when the toner images, which have been transferred onto the intermediate transfer belt 11 by the first transfer to be superimposed at the same position on the intermediate transfer belt 11, are transported to the second transfer position. The toner images on the intermediate transfer belt 11 are transferred onto a recording sheet at once (the second transfer) at the second transfer position by the second transfer roller 46.

Each of the rollers and roller pairs, such as the feed roller 42, transport roller pair 43, timing roller pair 45, and ejection roller pair 74, is powered by a drive motor (not illustrated), and is driven to rotate via a power transmission mechanism (not illustrated) such as gears and/or a belt. As the drive motor, a stepping motor, which can control the rotational speed with high accuracy, may be used, for example.

[2] Structure of Controller 60

Figure 4:
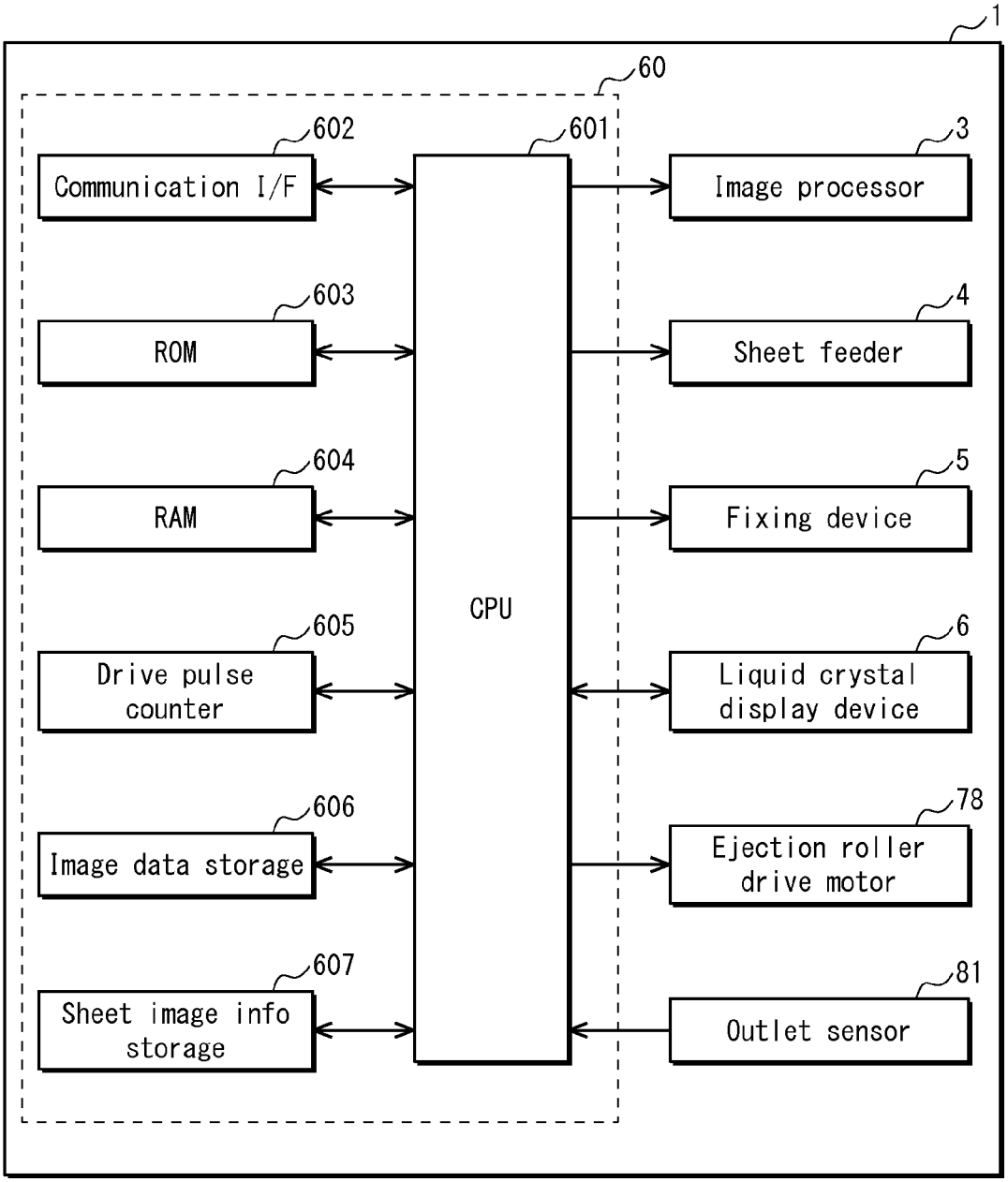
FIG. 4 is a diagram illustrating the structure of the controller and the relationship between the controller and the main structural elements targeted to be controlled by the controller.

FIG. 4 is a diagram illustrating the structure of the controller 60 and the relationship between the controller 60 and the main structural elements targeted to be controlled by the controller 60. The controller 60 is a so-called computer, and as illustrated in FIG. 4, includes a CPU (Central Processing Unit) 601, a communication interface (I/F) 602, a ROM (Read Only Memory) 603, a RAM (Random Access Memory) 604, a drive pulse counter 605, an image data storage 606, and a sheet image information storage 607.

The communication I/F 602 is an interface, such as a LAN card or a LAN board, for connecting to a LAN. In this example, the LAN is connected to the Internet via a router (not illustrated). The ROM 602 stores programs such as: a control program for controlling the image processor 3, the sheet feeder 4, the fixing device 5, the liquid crystal display device 6, an ejection roller drive motor 78, and the outlet sensor 81; an OS (Operating System); a browser program; and a program for executing an ejection state display process which is described below.

The OS is a program for managing the operation of the controller 60, and the various programs stored in the ROM 602 are executed under the management of the OS. As the OS, Windows™ or UNIX™ may be used, for example. The browser program is a software application used for browsing web pages provided by web servers via the Internet.

The RAM 604 is used as a work area by the CPU 601 when it executes a program. The drive pulse counter 605 counts drive pulses output to the ejection roller drive motor 78 that drives the ejection roller pair 74. The image data storage 606 stores image data for printing (for example, image data of a web page obtained from a web server) that has been input via the communication interface 602.

The sheet image information storage 607 stores a "display-lower-end reaching count value", an "ejection roller releasing count value", "sheet image information", a conversion table and the like. The "display-lower-end reaching count value" refers to the number of drive pulses that need to be output to the ejection roller drive motor 78 for the ejection roller pair 74 to transport the tip of the recording sheet from a position at the time when the outlet sensor 81 detects the tip, to a position facing the lower end of the display surface of the liquid crystal display device 6 (hereinafter referred to as a "lower end facing position").

The "ejection roller releasing count value" refers to the number of drive pulses that need to be output to the ejection roller drive motor 78 for the ejection roller pair 74 to transport the recording sheet from the position at the time when the outlet sensor 81 detects the tip of the recording sheet, to a position when the rear end of the recording sheet is released from the ejection roller pair 74.

The above-described count values are respectively used in the ejection state display process, which is described below, to judge whether or not the recording sheet after the printing process has reached the lower end facing position, and to judge whether or not the recording sheet has been released from the ejection roller pair 74.

Figure 5:
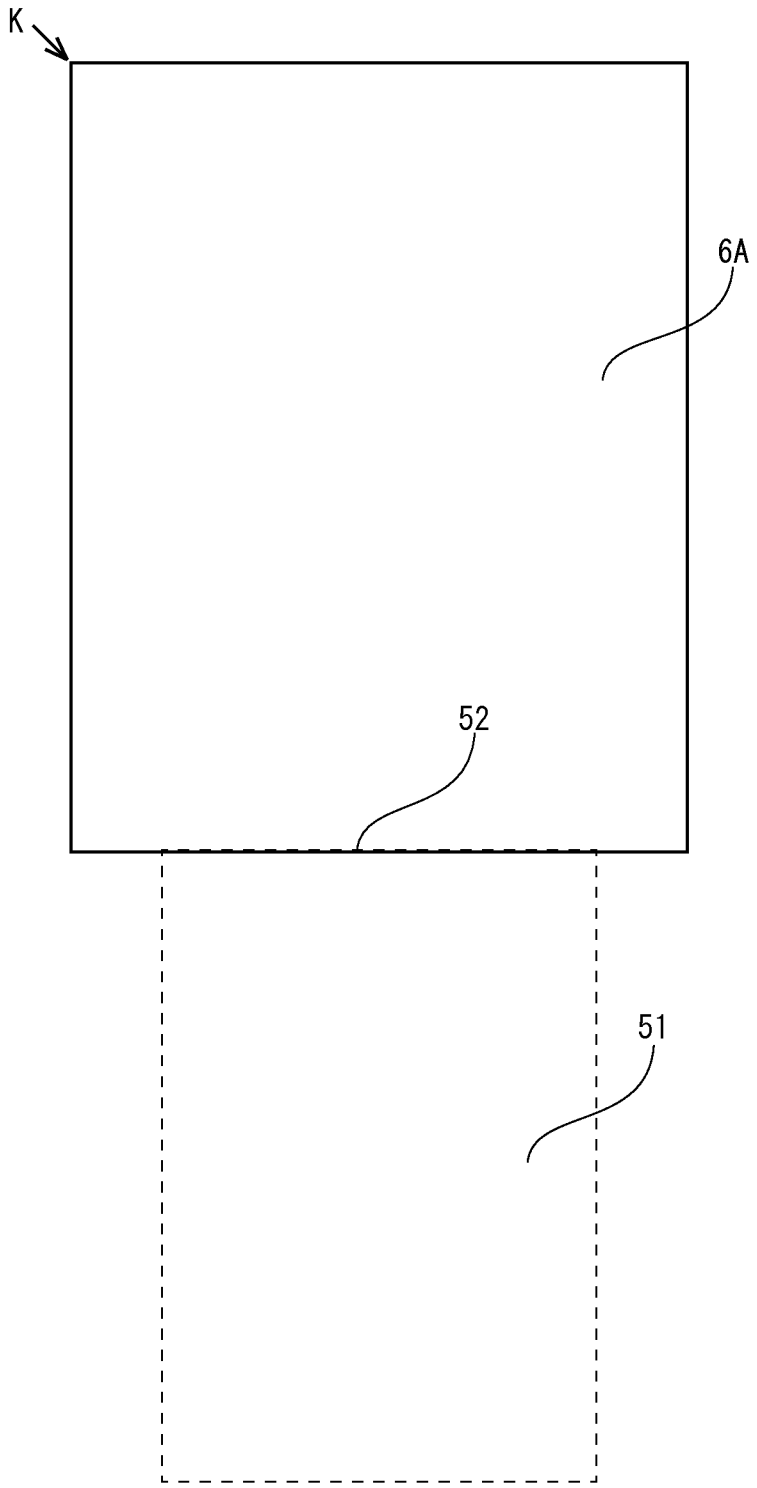
FIG. 5 is a diagram schematically illustrating a state where the sheet image represented by the display data is at the initial position.

The "sheet image information" is information including: (a) display data of a sheet image (in this example, an image of a recording sheet of a predetermined size) that is displayed on the display of the liquid crystal display device 6 to indicate that the recording sheet after the printing process has been ejected; and (b) the display coordinates of the sheet image. As illustrated in FIG. 5, the display coordinates are set to indicate a position (hereinafter referred to as an "initial position") where the tip of the sheet image matches the lower end of the display surface 6A of the liquid crystal display device 6.

FIG. 5 is a diagram schematically illustrating a state where the sheet image represented by the display data is at the initial position. Sign 6A in FIG. 5 denotes the display surface of the liquid crystal display device 6, sign 51 the sheet image represented by the display data, and sign 52 the tip position of the sheet image. Note that, in this example, the display coordinates are represented by an xy orthogonal coordinate system in which the origin of the display coordinates is assumed to be the upper-left position of the display surface 6A (the position indicated by the arrow "K"), the downward direction from the origin is assumed to be a positive direction of the y-coordinate, and the upward direction from the origin is assumed to be a negative direction of the y-coordinate. Furthermore, the rightward direction from the origin is assumed to be a positive direction of the x-coordinate, and the leftward direction from the origin is assumed to be a negative direction of the x-coordinate.

In the ejection state display process described below, each time a predetermined time period (in this example, one second) passes after when the printed recording sheet reaches the lower end facing position, the y-coordinate value of the display coordinates is updated by being decreased by a value corresponding to a transport distance (the distance of a transport in the upward, namely negative direction of the y-coordinate) of the recording sheet transported by the ejection roller pair 74 during the predetermined time period, and the sheet image is displayed on the display of the liquid crystal display device 6 at a position indicated by the updated y-coordinate value.

This makes it possible to move the position of the sheet image displayed on the display of the liquid crystal display device 6 in conjunction with the movement (movement in the negative direction of the y-coordinate) of the recording sheet by the ejection roller pair 74. Note that the size of the sheet image is set to a size that is slightly larger than the actual size of the recording sheet so that the operator can easily recognize the contour of the sheet image displayed on the display even after the recording sheet after the print process is transported to the position facing the display surface of the liquid crystal display device 6.

The "conversion table" refers to a table that indicates a correspondence relationship between the number of drive pulses and the transport distance of the recording sheet transported by the ejection roller pair 74.

Back to the explanation with reference to FIG. 4, the liquid crystal display device 6 includes a liquid crystal display, wherein the touch panel is laminated on the surface of the liquid crystal display. The liquid crystal display device 6 receives an instruction input by the user by means of touching the touch panel or pressing the keys, and notifies the controller 60 of the received instruction. The ejection roller drive motor 78 is a drive motor for driving the ejection roller pair 74, and performs the driving in accordance with drive pulses output from the controller 60.

[3] Ejection State Display Process

Figure 6:
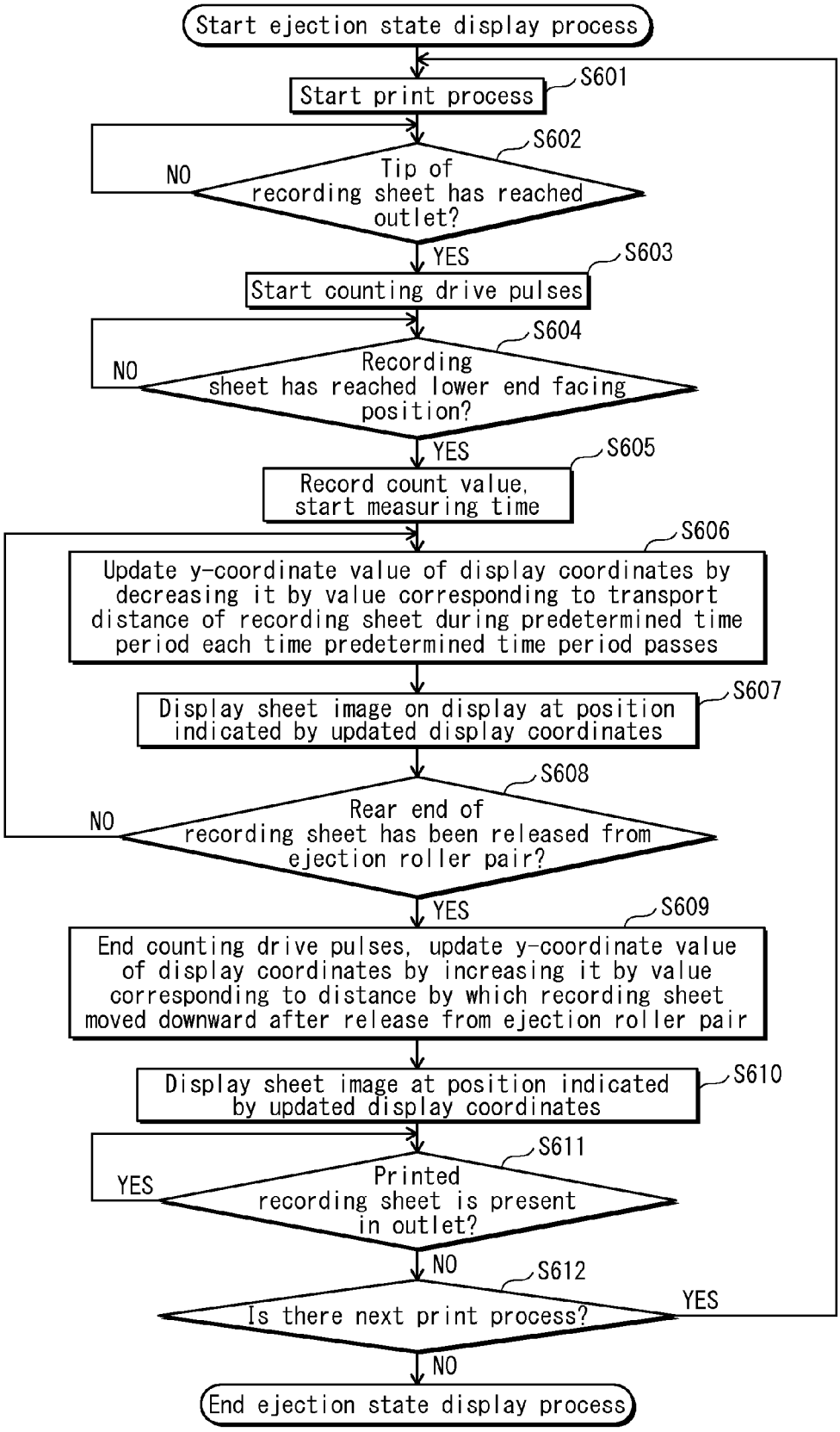
FIG. 6 is a flowchart illustrating the procedure of the ejection state display process performed by the controller.

FIG. 6 is a flowchart illustrating the procedure of the ejection state display process performed by the controller 60. After activating the program for executing the ejection state display process, the controller 60 reads the display-lower-end reaching count value, ejection roller releasing count value, sheet image information, and conversion table from the sheet image information storage 607 into the RAM 604, and upon receiving an instruction to start the print process for printing a print target (for example, an image displayed on the liquid crystal display device 6) specified on the touch panel of the liquid crystal display device 6, controls the image processor 3, sheet feeder 4, and fixing device 5 to start the print process for printing the specified print target (step S601), and judges whether or not the tip of the printed recording sheet has reached the outlet 80 by monitoring the detection result of the outlet sensor 81 (step S602).

When it judges that the tip of the recording sheet has reached the outlet 80 (step S602: YES), the controller 60 causes the drive pulse counter 605 to start counting the drive pulses output to the ejection roller drive motor 78 (step S603), and judges whether or not the tip of the recording sheet has reached the lower end facing position by checking whether or not the count value of the drive pulse counter 605 (hereinafter merely referred to as "count value") has reached the display-lower-end reaching count value (step S604).

When it judges that the count value has reached the display-lower-end reaching count value, the controller 60 judges that the tip of the recording sheet has reached the lower end facing position (step S604: YES), records the count value at that time onto the RAM 604 and starts measuring the time (step S605).

Each time a predetermined time period (in this example, one second) passes, the controller 60 records the count value at that time onto the RAM 604, calculates a difference from an immediately recorded count value, obtains, by referring to the conversion table, a transport distance of the recording sheet during the predetermined time period (one second) corresponding to the calculated difference, and updates the y-coordinate value of the display coordinates by decreasing it by a value corresponding to the obtained transport distance (step S606).

Subsequently, the controller 60 displays a sheet image on the display of the liquid crystal display device 6 at a position indicated by the updated display coordinates (step S607).

The controller 60 repeats the processes of steps S606 and S607 until it judges that the count value has reached the ejection roller releasing count value and that the rear end of the recording sheet has been released from the ejection roller pair 74 (step S608:YES).

This makes it possible to move the position of the sheet image displayed on the display of the liquid crystal display device 6 in conjunction with the movement of the recording sheet in the upward direction (movement in the negative direction of the y-coordinate) by the ejection roller pair 74.

Figure 7A:
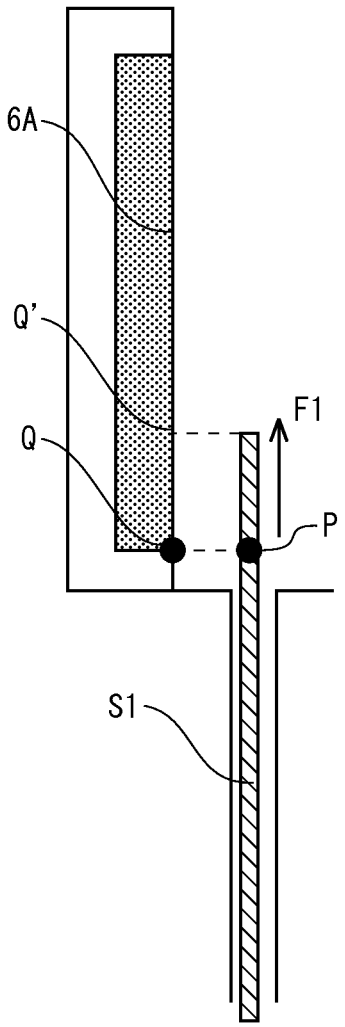
FIGS. 7A and 7B are a side view and a front view of the printer schematically illustrating the state where the tip of the printed recording sheet has passed the lower end facing position and the recording sheet is being moved in the upward direction by the ejection roller pair.
Figure 7B:
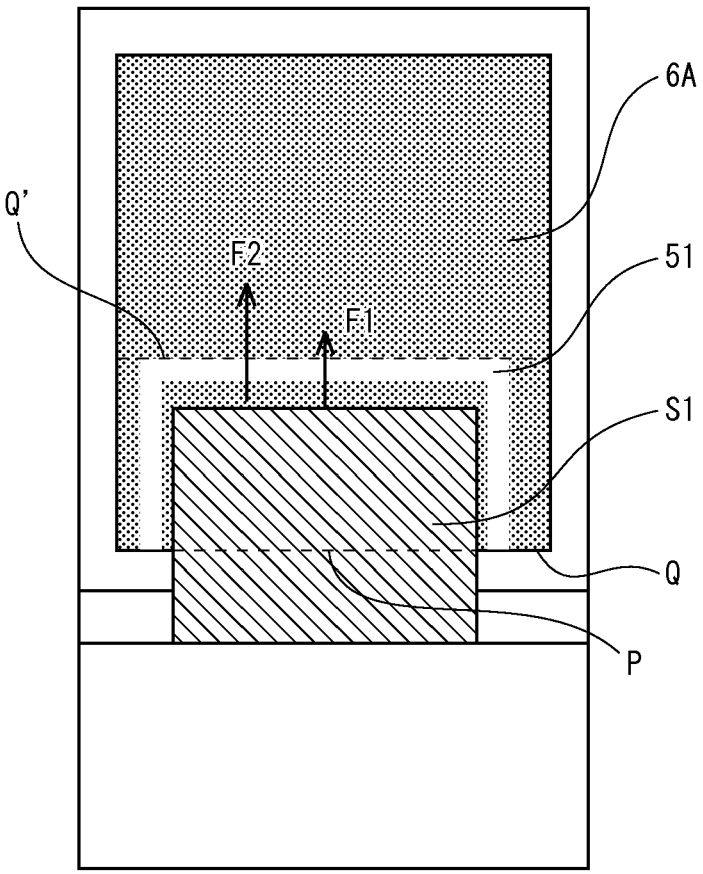

FIG. 7A is a side view of the printer 1 schematically illustrating the state where the tip of the printed recording sheet has passed the lower end facing position and the recording sheet is being moved in the upward direction by the ejection roller pair 74. FIG. 7B is a front view of the printer 1 schematically illustrating the state where the tip of the printed recording sheet has passed the lower end facing position and the recording sheet is being moved in the upward direction by the ejection roller pair 74. In FIGS. 7A and 7B, sign 6A denotes the display surface of the liquid crystal display device 6, sign S1 denotes the printed recording sheet after the print process, sign 51 denotes the sheet image, sign P denotes the lower end facing position, sign Q denotes the initial position, and sign Q' denotes a position of the y-coordinate on the display surface 6A of the liquid crystal display device 6 facing the tip position of the recording sheet S1.

As illustrated in FIGS. 7A and 7B, in conjunction with the movement of the recording sheet S1 in the upward direction (movement in the negative direction of the y-coordinate) indicated by the arrow F1 after having passed the lower end facing position P, a sheet image 51 moves from the initial position Q, which corresponds to the lower end facing position P, in the same direction (direction indicated by the arrow F2) by a distance corresponding to the movement distance of the recording sheet S1 from the lower end facing position P.

When the count value has reached the ejection roller releasing count value, the controller 60 judges that the rear end of the recording sheet has been released from the ejection roller pair 74 (step S608:YES), causes the drive pulse counting operation to end. Subsequently, the rear end of the recording sheet moves into the stocker 77. The controller 60 updates the y-coordinate value of the display coordinates by increasing it by a value corresponding to a distance by which the recording sheet moved in the downward direction (movement in the positive direction of the y-coordinate) (step S609), and displays the sheet image at a position indicated by the updated display coordinates on the display surface of the liquid crystal display device 6 (step S610).

Figure 8A:
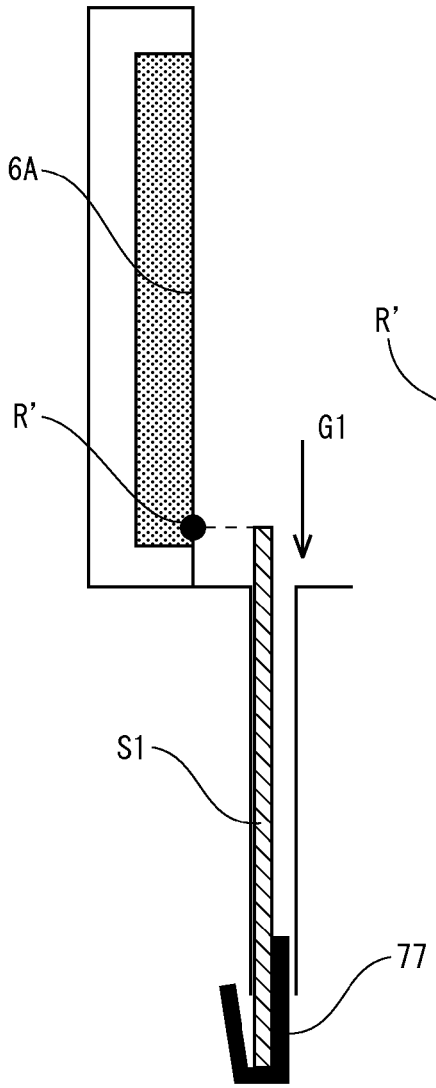
FIGS. 8A and 8B are a side view and a front view of the printer schematically illustrating the state where the rear end of the printed recording sheet has been released from the ejection roller pair and is held by the stocker.
Figure 8B:
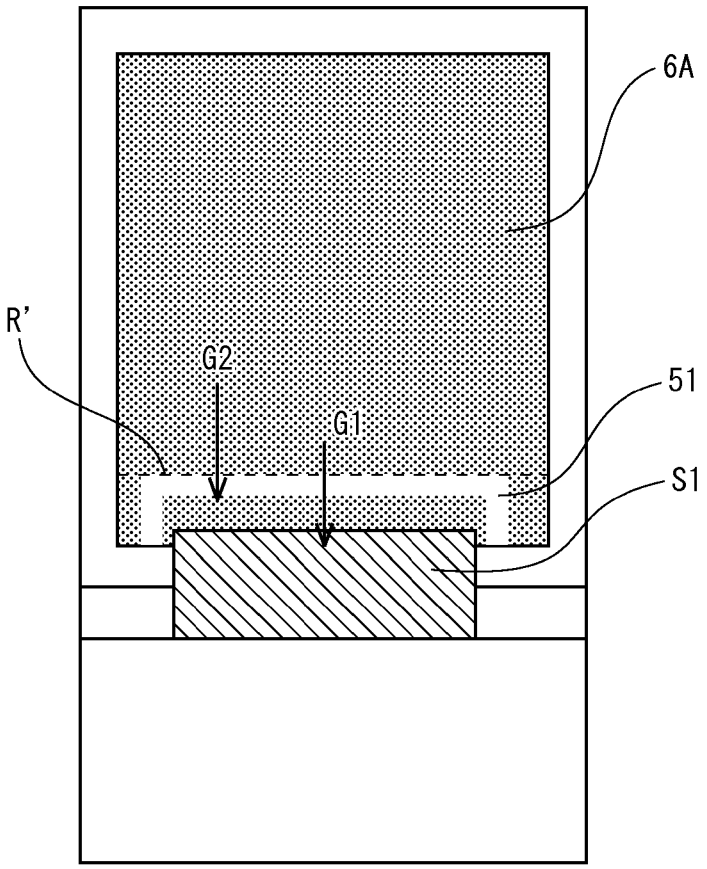

This makes it possible to move the display position of the sheet image displayed on the display of the liquid crystal display device 6 in the positive direction of the y-coordinate in conjunction with the movement (movement in the positive direction of the y-coordinate) of the recording sheet in the downward direction when the rear end of the recording sheet is released from the ejection roller pair 74 and is guided into the stocker 77. FIG. 8A is a side view of the printer 1 schematically illustrating the state where the rear end of the printed recording sheet has been released from the ejection roller pair 74 and is held by the stocker 77. FIG. 8B is a front view of the printer 1 schematically illustrating the state where the rear end of the printed recording sheet has been released from the ejection roller pair 74 and is held by the stocker 77.

In FIGS. 8A and 8B, sign 6A denotes the display surface of the liquid crystal display device 6, sign S1 denotes the printed recording sheet after the print process, sign 51 denotes the sheet image, sign 77 denotes the stocker, and sign R' denotes a position of the y-coordinate on the display surface 6A of the liquid crystal display device 6 facing the tip position of the recording sheet S1 after the descent.

As illustrated in FIGS. 8A and 8B, in conjunction with the movement of the recording sheet S1 in the downward direction (movement in the positive direction of the y-coordinate) indicated by the arrow G1 after the rear end of the printed recording sheet S1 is released from the ejection roller pair 74 and is held by the stocker 77, the sheet image 51 moves in the same direction (direction indicated by the arrow G2) by a distance corresponding to the distance by which the recording sheet S1 moved in the downward direction.

Next, the controller 60 obtains the detection result of the outlet sensor 81, and judges whether or not the recording sheet is present in the outlet 80 (step S611). When it judges that the recording sheet is present in the outlet 80 (step S611: YES), the controller 60 prohibits the next print process from being executed; and when it judges that the recording sheet is not present in the outlet 80 (step S611: NO) and there is a next print process to be executed (step S612: YES), the controller 60 proceeds to step S601 and executes the next print process.

As described above, the sheet image displayed on the display reflects the progress of the ejection of the recording sheet after the print process. This makes it easy for the user to check the ejection state of the recording state, improving the user friendliness in obtaining the recording sheet after the print process.

(Modifications)

Up to now, the present invention has been described specifically through the embodiment. However, the present invention is not limited to the above-described embodiment, but may be modified variously as in the following.

Figure 9:
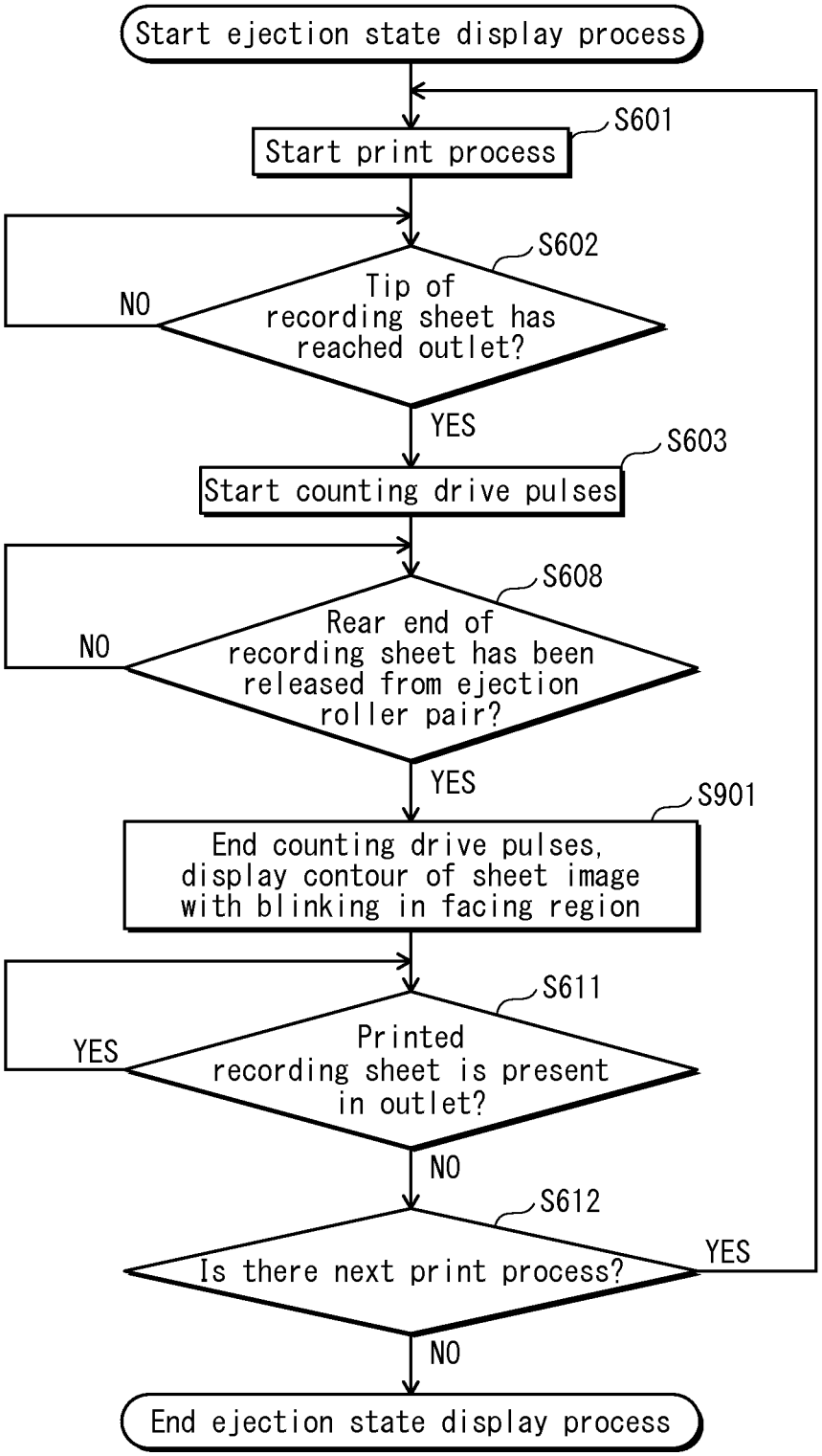
FIG. 9 is a flowchart illustrating the procedure of the ejection state display process in a modification.

(1) In the embodiment described above, in the ejection state display process, how the ejection of the recording sheet after the print process is progressing is displayed on the display of the liquid crystal display device 6. However, not limited to this structure, the position of the ejected recording sheet after the completion of the ejection may be displayed on the display of the liquid crystal display device 6. FIG. 9 is a flowchart illustrating the procedure of the ejection state display process in a modification. In FIG. 9, the same step numbers are used for the same processes as the processes illustrated in FIG. 6, the following describes the differences from the ejection state display process of FIG. 6.

After performing the processes of steps S601 to S603, the controller 60 performs the process of step S608, and when it judges that the count value has reached the ejection roller releasing count value and that the rear end of the recording sheet has been released from the ejection roller pair 74 (step S608:YES), the controller 60 causes the drive pulse counting operation to end. Subsequently, the controller 60 displays a sheet image in a region in the display surface of the liquid crystal display device 6 that faces the recording sheet (hereinafter the region is referred to as "facing region"), at the position of the ejected recording sheet (at the position when the rear end of the recording sheet is held by the stocker 77), and displays the contour of the sheet image with blinking in the facing region (step S901).

Figure 10A:
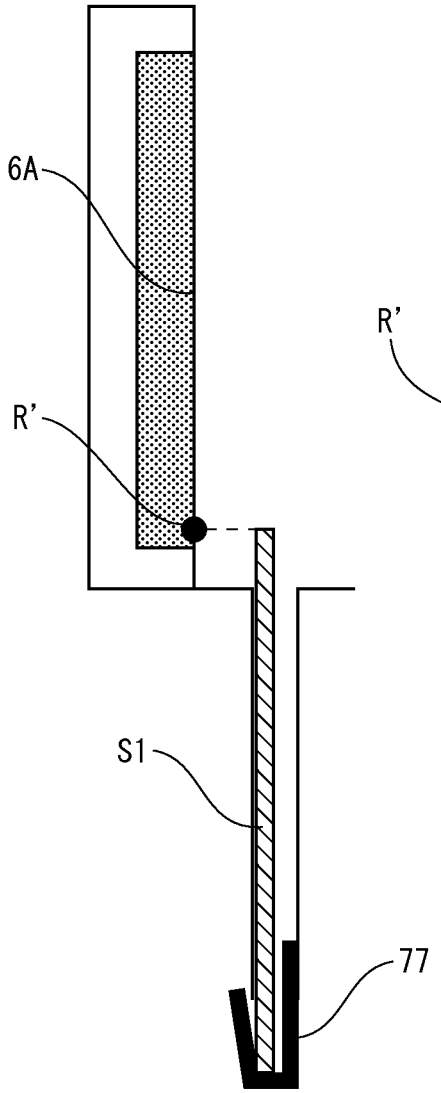
FIGS. 10A and 10B are a side view and a front view of the printer in the modification, schematically illustrating the state where the rear end of the printed recording sheet has been released from the ejection roller pair and is held by the stocker.
Figure 10B:
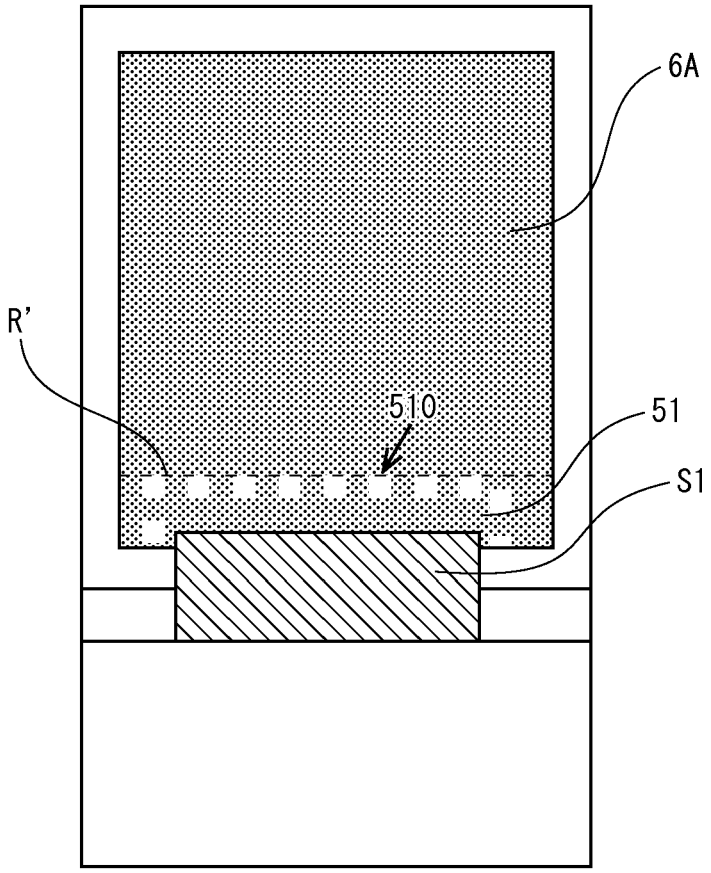

FIGS. 10A and 10B are, as is the case with FIGS. 8A and 8B, respectively a side view and a front view of the printer 1 schematically illustrating the state where the rear end of the printed recording sheet has been released from the ejection roller pair 74 and is held by the stocker 77. In both FIGS. 10A and 10B and FIGS. 8A and 8B, the same signs are used, except for sign 510. Thus in the following, only sign 510 is explained, and explanation of the other signs is omitted. The white dots indicated by the sign 510 represent the contour of the sheet image displayed with blinking.

As illustrated in FIGS. 10A and 10B, the sheet image indicated by the sign 51 is displayed in the facing region, and the contour of the sheet image indicated by the sign 510 is displayed with blinking Note that the display coordinates indicating the position of the sheet image displayed in the facing region are determined by the manufacturer side of the printer 1 in advance and stored in the sheet image information storage 607.

After performing the process of step S901, the controller 60 performs the processes of steps S611 and S612.

With this structure, the contour of the sheet image is displayed with blinking in the facing region. This makes it possible for the user to easily recognize, from the displayed image, that the recording sheet after the print process has been ejected, and the position of the ejected recording sheet.

(2) In the modification (1) described above, the sheet image is displayed in the facing region and the contour or the sheet image is displayed with blinking to indicate the ejection position of the recording sheet after the print process after completion of the ejection operation. However, not limited to this, instead of the display with blinking, when a predetermined time period has passed after the ejection of the recording sheet, the recording sheet may be moved vertically, and in conjunction with this movement, the displayed sheet image may be moved vertically in the facing region on the display of the liquid crystal display device 6.

Figure 11:
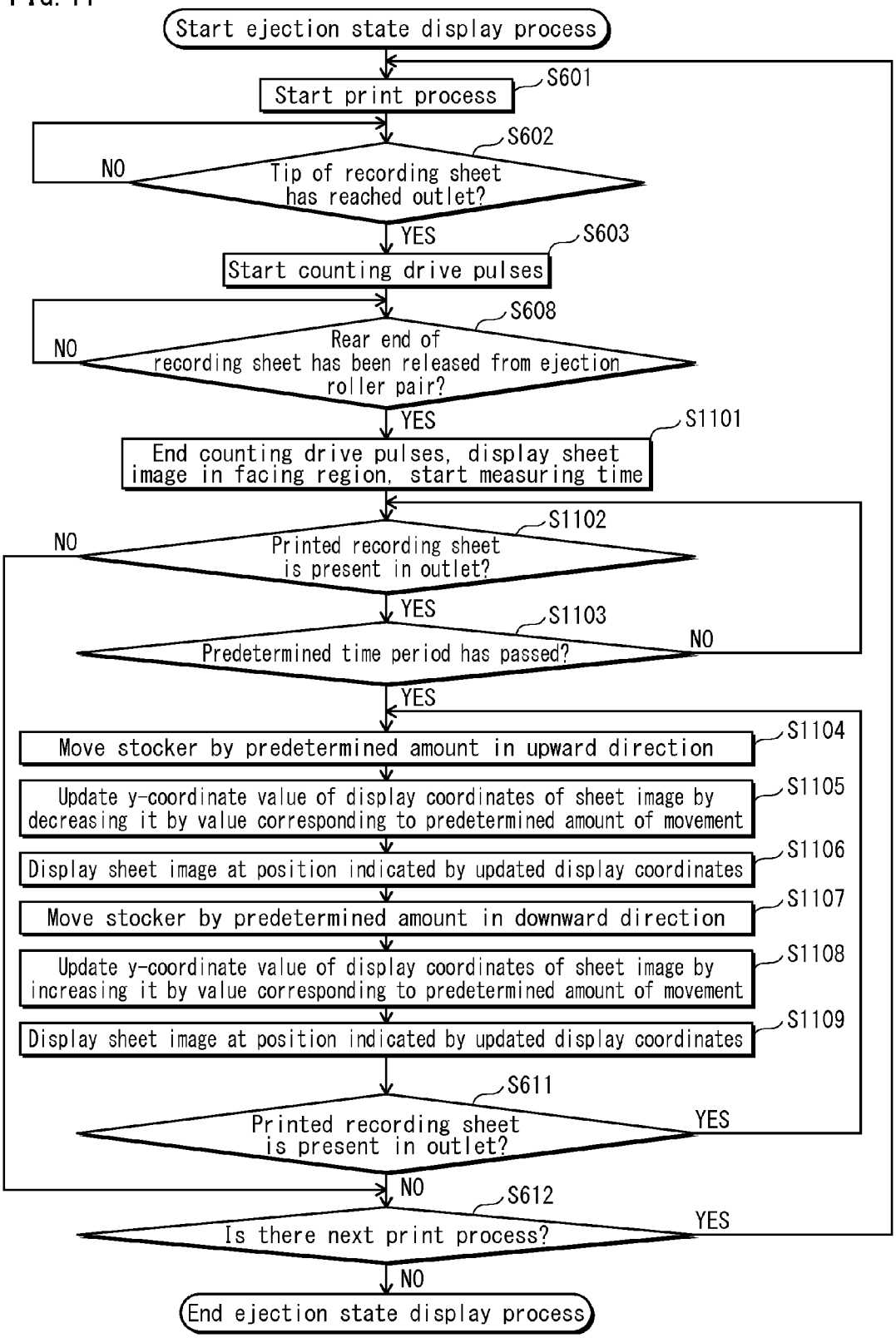
FIG. 11 is a flowchart illustrating the procedure of the ejection state display process in another modification.

FIG. 11 is a flowchart illustrating the procedure of the ejection state display process in another modification. After performing the processes of steps S601 to S603, the controller 60 performs the process of step S608, and when it judges that the count value has readied the ejection roller releasing count value and that the rear end of the recording sheet has been released from the ejection roller pair 74 (step S608:YES), the controller 60 causes the drive pulse counting operation to end. Subsequently, the controller 60 displays a sheet image in the facing region, and starts measuring the time (step S1101).

While the recording sheet after the print process is present in the outlet 80 (step S1102: YES), when a predetermined time period (for example, three minutes) passes from the start of the time measuring (step S1103: YES), the controller 60 ends the time measuring, causes a stocker movement mechanism to move the stocker 77 by a predetermined amount in the upward direction (move in the negative direction of the y-coordinate) (step S1104), updates the y-coordinate value of the display coordinates of the sheet image by decreasing it by a value corresponding to the predetermined amount of movement (step S1105), and displays the sheet image at a position indicated by the updated display coordinates on the display of the liquid crystal display device 6 (step S1106).

Subsequently, the controller 60 causes the stocker movement mechanism to move the stocker 77 by a predetermined amount in the downward direction (move in the positive direction of the y-coordinate) (step S1107), updates the y-coordinate value of the display coordinates of the sheet image by increasing it by a value corresponding to the predetermined amount of movement (step S1108), and displays the sheet image at a position indicated by the updated display coordinates on the display of the liquid crystal display device 6 (step S1109).

As the stocker movement mechanism, a linear movement mechanism that converts a rotational movement into a linear movement may be used. For example, the stocker movement mechanism may be composed of stepping motors, gears, gear/pulleys, timing belts and the like (see, for example, paragraphs 0035 and 0036 in the specification and FIG. 6 of Japanese Patent Application Publication No. 2009-1426). Furthermore, the amount of the y-coordinate to be decreased or increased may be determined by the manufacturer side of the printer 1 in advance and stored in the controller 60.

Figure 12A:
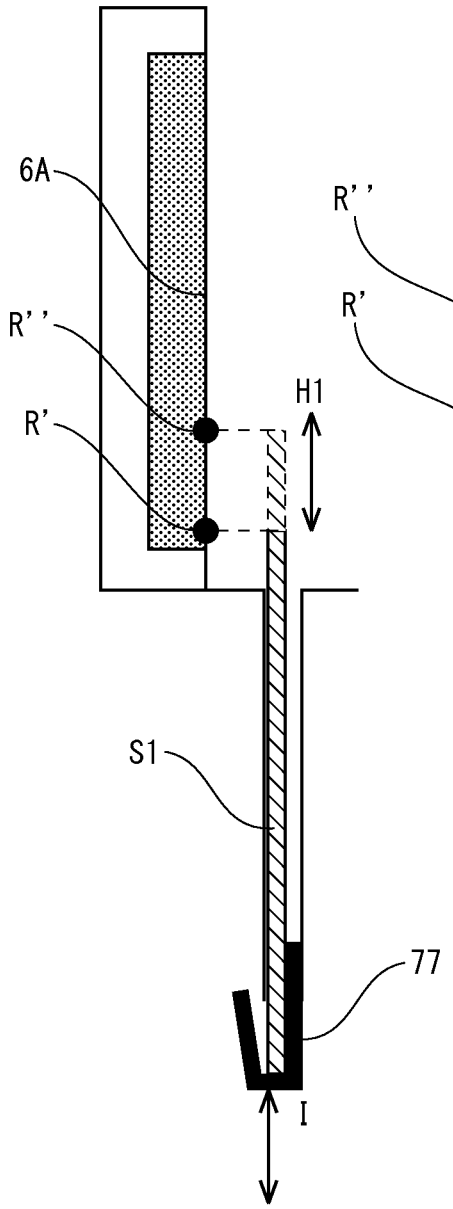
FIG. 12A and FIG. 12B are a side view and a front view of the printer in said another modification, schematically illustrating the state of the printer when a predetermined time period has passed after the rear end of the printed recording sheet was released from the ejection roller pair and held by the stocker.
Figure 12B:
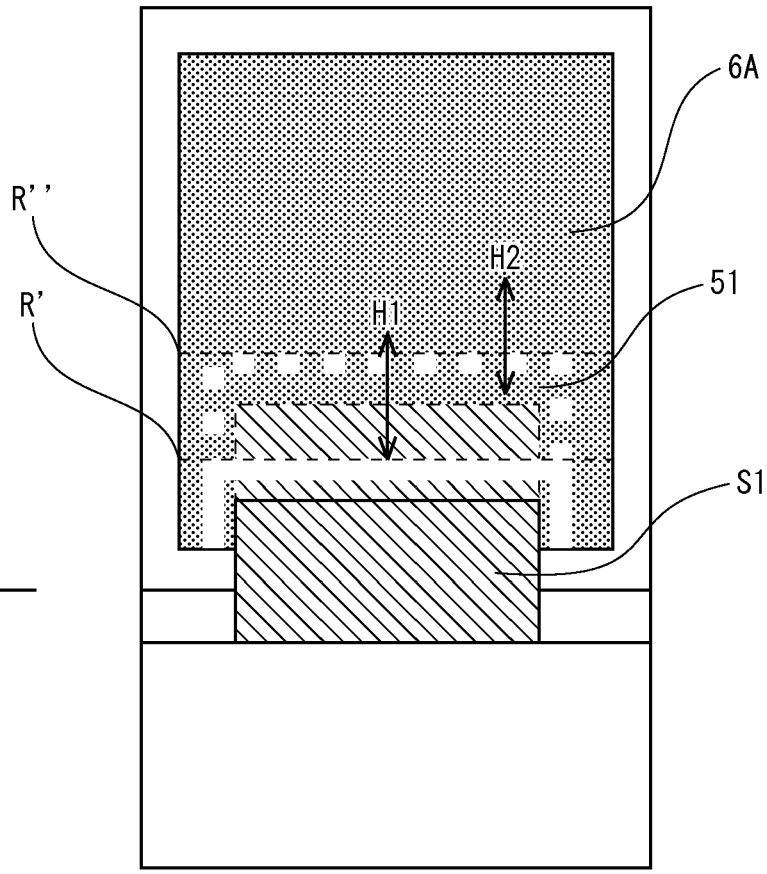

With the execution of the processes of steps S1104 to S1109, as illustrated in FIGS. 12A and 12B, the sheet image displayed on the display of the liquid crystal display device 6 may be moved vertically in conjunction with the vertical movement of the recording sheet after the print process. FIG. 12A is a side view of the printer 1 schematically illustrating the state of the printer 1 when a predetermined time period has passed after the rear end of the printed recording sheet was released from the ejection roller pair 74 and held by the stocker 77. FIG. 12B is a front view of the printer 1 schematically illustrating the state of the printer 1 when a predetermined time period has passed after the rear end of the printed recording sheet was released from the ejection roller pair 74 and held by the stocker 77.

In both FIGS. 12A and 12B and FIGS. 10A and 10B, the same signs are used. Thus in the following, explanation of these signs is omitted. The bidirection arrow indicated by sign H1 in FIGS. 12A and 12B indicates the movement direction of the recording sheet S1. The bidirection arrow indicated by sign H2 indicates the movement direction of the sheet image. The bidirection arrow indicated by sign I indicates the movement direction of the stocker 77. Sign R" indicates the position of the y-coordinate on the display surface of the liquid crystal display device 6 facing the tip position of the recording sheet S1 after the recording sheet S1 has moved in the upward direction by a predetermined amount.

After performing the process of step S1109, the controller 60 performs the processes of steps S611 and S612.

(3) In the embodiment described above, in the ejection state display process illustrated in FIG. 6, when it is judged that the recording sheet is present in the outlet 80 (step S611: YES), the controller 60 prohibits the next print process from being executed. However, instead of prohibiting the next print process, the printer 1 may receive a print process execution instruction from the user via an instruction button that is displayed in the facing region. This makes it difficult for the user to input a print process execution instruction when the recording sheet after the print process is present in the outlet 80, thereby suppressing the next print process from being executed while the recording sheet is present in the outlet 80.

(4) In the embodiment described above, the recording sheet after the print process is ejected along the display surface of the liquid crystal display device 6, thereby improving the operability of the user. However, it is also possible to improve the operability of the user even if the recording sheet is ejected separately from the display surface of the liquid crystal display device 6, as far as it is ejected in a direction approaching the display surface of the liquid crystal display device 6 (a direction satisfying the relationship $\alpha \leq \theta$).

Figure 13:
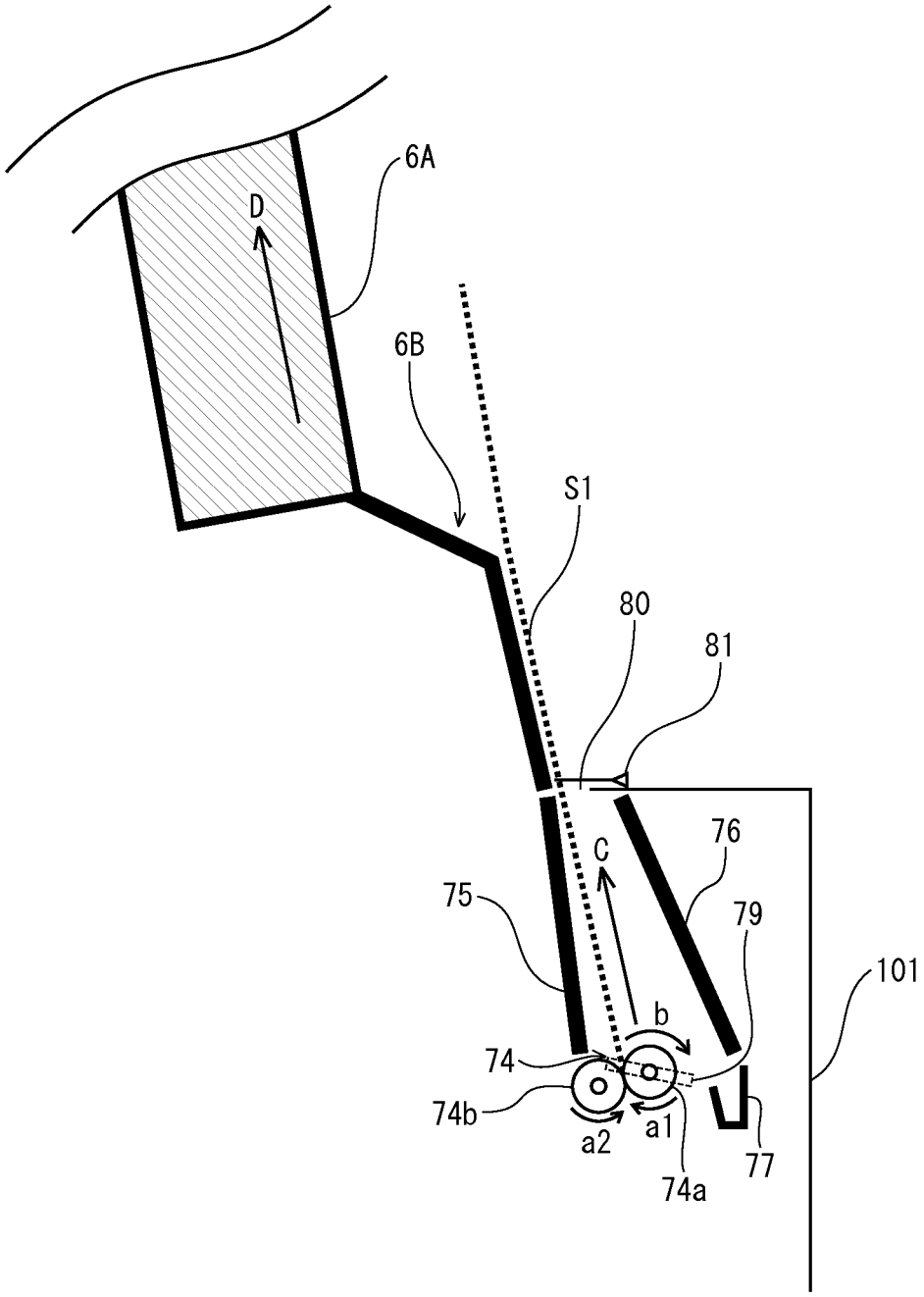
FIG. 13 is a cross-sectional view illustrating the details of the periphery of the ejection roller pair in a still another modification.
Figure 14:
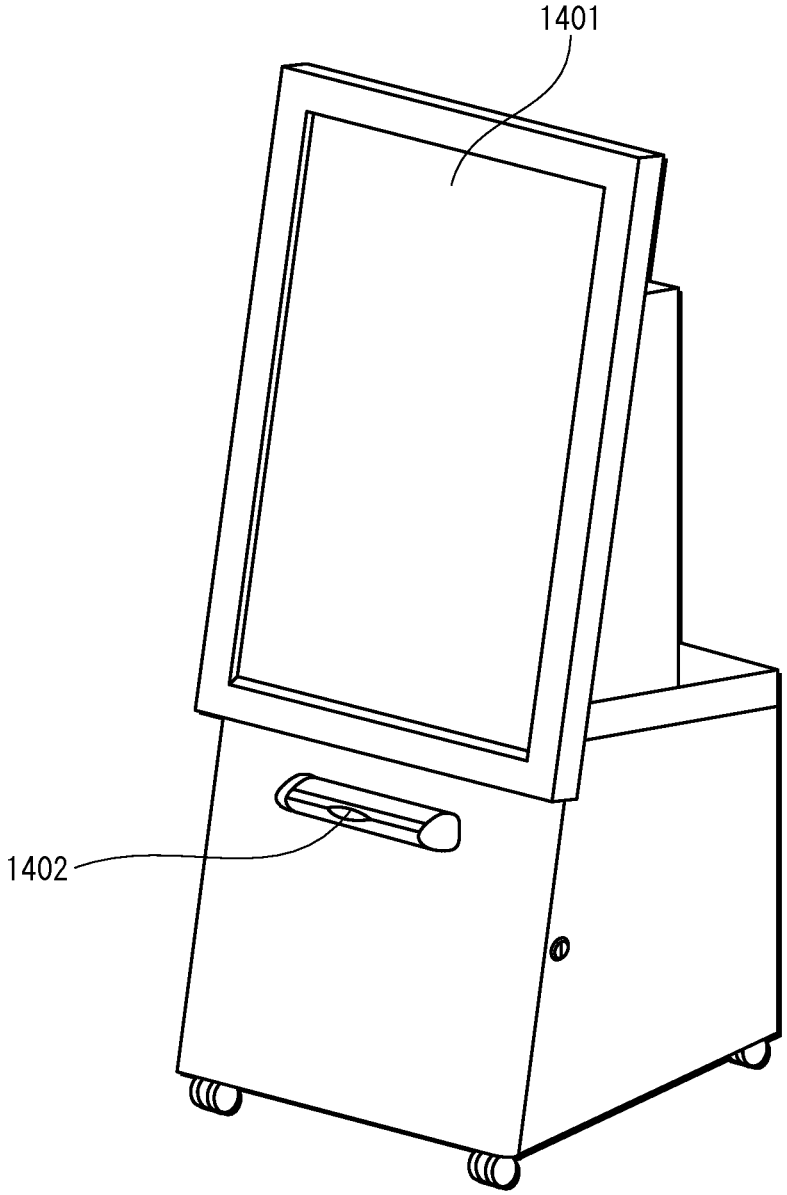
FIG. 14 Prior Art
FIG. 14 illustrates a specific example of a conventional image forming apparatus with a display.

For example, as illustrated in FIG. 13, a lower frame part 6B of the liquid crystal display device 6 may be bent in cross section so that the lower frame part 6B is used as an ejection guide of the recording sheet. Furthermore, the inclination angles may be set such that, in the state where the recording sheet S1 after the print process is separated from the display surface 6A of the liquid crystal display device 6, as is the case with the structure illustrated in FIG. 3C, an inclination angle $\alpha$ is not more than an inclination angle $\theta$, the inclination angle $\alpha$ being made between the display surface 6A of the liquid crystal display device 6 (the direction indicated by the arrow D) and the direction in which the recording sheet is ejected by the ejection roller pair 74 (the direction indicated by the arrow C), and the inclination angle $\theta$ being made between the display surface 6A of the liquid crystal display device 6 and the vertical direction, Note that in FIG. 13, the structural elements common to FIG. 3A are assigned the same signs.

(5) In the embodiment described above, the printer 1 is structured such that the front end of the recording sheet after the print process is located along the display surface of the liquid crystal display device 6 in the state where the rear end of the recording sheet is held by the stocker 77. However, the tip of the recording sheet may not necessarily face the display surface, but may face the outer front surface of the display part 1B located below the display surface. This is because the user, while seeing the display of the liquid crystal display device 6, can visually recognize that the recording sheet has been ejected, if the ejected recording sheet is placed at a position where at least a part of the recording sheet is located along the outer front surface of the display part 1B. This also applies to the case where the recording sheet is ejected.

(6) In the embodiment described above, how the ejection of the recording sheet is progressing is indicated by the sheet image displayed on the display of the liquid crystal display device 6. However, not limited to the sheet image, another image may be displayed for this purpose. For example, an image of a predetermined character may be displayed on the display of the liquid crystal display device 6 to indicate how the ejection of the recording sheet is progressing.

(7) In the embodiment described above, the recording sheet after the print process is ejected in the upward direction. However, not limited to the upward direction, the recording sheet may be ejected in any direction approaching the display surface of the liquid crystal display device 6. For example, the recording sheet may be ejected in a horizontal direction, and in the case of a desktop printer, may be ejected in a downward direction. In that case, the rear end of the recording sheet may be held by the ejection rollers. For example, when the rear end of the recording sheet reaches the ejection rollers, the operation of the ejection rollers may be stopped.

<Summary>

According to one embodiment of the present invention described above, there is provided an image forming apparatus comprising: a housing; a display whose display surface is provided on a front-surface side of the housing; an image forming unit provided in the housing and configured to form an image on a recording sheet; and an ejector configured to eject the recording sheet with the image formed thereon from inside to outside of the housing in a direction approaching the display surface.

In the above-described image forming apparatus, the ejector may be provided below the display surface in a vertical direction, and the direction approaching the display surface may be in a range where an inclination angle of the ejected recording sheet against the display surface is at most an inclination angle of the display surface against a vertical plane. Also, in the above-described image forming apparatus, when the ejection of the recording sheet is completed, at least a part of the recording sheet may be located along the display surface.

In the above-described image forming apparatus, the display may have a frame surrounding the display surface, and a portion of the frame located between the display surface and the ejector functions as an ejection guide for guiding the recording sheet in the direction approaching the display surface.

With the above-described structure, the recording sheet with the image formed thereon is ejected from inside to outside of the housing in a direction approaching the display surface. This makes it possible for the user, when the recording sheet is ejected while the user is seeing the display, to easily recognize the ejection of the recording sheet. Furthermore, compared with a case where the recording sheet is ejected toward the front of the printer, this structure of the present invention makes it difficult for the ejected recording sheet to collide with the body of the user standing in front of the printer seeing the display. As a result, this structure improves user operability at the ejection of the recording sheet.

The above-described image forming apparatus may further comprise: a display controller configured to, when the recording sheet is ejected by the ejector, display, on the display, a display image indicating that the recording sheet is ejected.

In the above-described image forming apparatus, the display controller may change a display position of the display image in conjunction with a movement of the recording sheet ejected by the ejector.

With this structure, ejection of a recording sheet with an image formed thereon is indicated by the image displayed on the display. This makes it possible for the user to check the ejection of the recording sheet via the display, without directly watching how the recording sheet is ejected. As a result, this structure further improves user operability at the ejection of the recording sheet.

The above-described image forming apparatus may further comprise: a holder configured to hold the recording sheet ejected by the ejector; a detector configured to detect whether or not the recording sheet is held by the holder; and a display controller configured to, when a time period during which the recording sheet is held by the holder reaches a predetermined time period, display, on the display, a display image indicating that the recording sheet is held.

The above-described image forming apparatus may further comprise: a movement controller configured to, when the time period during which the recording sheet is held by the holder reaches the predetermined time period, cause the holder to move, wherein the display controller changes a display position of the image in conjunction with a movement of the holder.

With the above-described structure, when the recording sheet with the image formed thereon is kept to be held by the holder for the predetermined time period, an image indicating that the recording sheet is held is displayed on the display. The displayed image notifies the user of the fact that the recording sheet is kept to be held, and effectively prevents the user from forgetting to pick up the recording sheet.

The above-described image forming apparatus may further comprise: a holder configured to hold the recording sheet ejected by the ejector; a detector configured to detect whether or not the recording sheet is held by the holder; and a prohibiting unit configured to, when the recording sheet is held by the holder, prohibit new formation of an image.

With the above-described structure, when the recording sheet with the image formed thereon is held by the holder, new formation of an image is prohibited. This helps the user pay attention not to forget to pick up a recording sheet every time a recording sheet is ejected, and prevents a large number of recording sheets from being kept to be held by the holder.

In the above-described image forming apparatus, a touch panel may be provided on the display surface, and the image forming apparatus may further comprise: a holder configured to hold the recording sheet ejected by the ejector, in a state where at least a part of the recording sheet is located along the display surface; and a receiving unit configured to display an instruction button in a portion of the display surface facing the part of the recording sheet, and receive, via the instruction button, an instruction to newly form an image on a recording sheet.

With the above-described structure, the recording sheet with an image formed thereon is held in a state where at least a part of the recording sheet is located along the display surface of the display, and an instruction button is displayed in a portion of the display surface facing the part of the recording sheet so that an instruction to newly form an image on a recording sheet can be received via the instruction button. This makes it difficult for the user to operate the instruction button unless the user removes the recording sheet from the holder. As a result, the user is urged to remove a recording sheet from the holder every time a recording sheet is ejected. This helps the user pay attention not to forget to pick up a recording sheet every time a recording sheet is ejected, and prevents a large number of recording sheets from being kept to be held by the holder.

Although the present invention has been fully described by way of examples with reference to the accompanying drawings, it is to be noted that various changes and modifications will be apparent to those skilled in the art. Therefore, unless such changes and modifications depart from the scope of the present invention, they should be construed as being included therein.

What is claimed is:

1. An image forming apparatus comprising:

a housing;

a display whose display surface is provided on a front-surface side of the housing;

an image forming unit provided in the housing and configured to form an image on a recording sheet;

a sheet stack internal to the housing; and an ejector configured to eject the recording sheet with the image formed thereon from inside to outside of the housing in a direction approaching the display surface, wherein the recording sheet is fed to the image forming unit from the sheet stack internal to the housing and the image forming apparatus is configured to convey the recording sheet from the sheet stack to the image forming unit internal to the housing, wherein when the ejection of the recording sheet is completed, at least a part of the recording sheet is located along the display surface.

2. The image forming apparatus of claim 1, wherein the ejector is provided below the display surface in a vertical direction, and the direction approaching the display surface is in a range where an inclination angle of the ejected recording sheet against the display surface is at most an inclination angle of the display surface against a vertical plane.

3. The image forming apparatus of claim 1 further comprising:

a controller configured to, when the recording sheet is ejected by the ejector, display, on the display, a display image indicating that the recording sheet is ejected.

4. The image forming apparatus of claim 3, wherein the controller changes a display position of the display image in conjunction with a movement of the recording sheet ejected by the ejector.

5. The image forming apparatus of claim 2 further comprising:

a holder configured to hold the recording sheet ejected by the ejector;

a detector configured to detect whether or not the recording sheet is held by the holder; and a controller configured to, when a time period during which the recording sheet is held by the holder reaches a predetermined time period, display, on the display, a display image indicating that the recording sheet is held.

6. The image forming apparatus of claim 5 wherein, the controller is further configured to, when the time period during which the recording sheet is held by the holder reaches the predetermined time period, cause the holder to move, and the controller is configured to change a display position of the image in conjunction with a movement of the holder.

7. The image forming apparatus of claim 1, further comprising:

a holder configured to hold the recording sheet ejected by the ejector;

a detector configured to detect whether or not the recording sheet is held by the holder; and a prohibiting unit configured to, when the recording sheet is held by the holder, prohibit new formation of an image.

8. The image forming apparatus of claim 1, wherein a touch panel is provided on the display surface, the image forming apparatus further comprising:

a holder configured to hold the recording sheet ejected by the ejector, in a state where at least the part of the recording sheet is located along the display surface; and a receiving unit configured to display an instruction button in a portion of the display surface facing the part of the recording sheet, and receive, via the instruction button, an instruction to newly form an image on a recording sheet.

9. The image forming apparatus of claim 1, wherein the display has a frame surrounding the display surface, and a portion of the frame located between the display surface and the ejector functions as an ejection guide for guiding the recording sheet in the direction approaching the display surface.

10. The image forming apparatus of claim 1, wherein the display surface is positioned at a display surface angle of inclination, and at a beginning of ejection as the recording sheet exits from inside to outside of the housing, a front end of the recording sheet and a rear end of the recording sheet each are at an ejection angle which is between the display surface angle of inclination and a vertical plane angle.

11. The image forming apparatus of claim 1, further comprising a plurality of transport roller pairs located inside of the housing and configured to transport the recording sheet from the image forming unit upwards to the ejector.

12. The image forming apparatus of claim 1, wherein when the ejector has completed ejection of the recording sheet, the recording sheet is oriented in the direction approaching the display surface.

13. An image forming apparatus comprising:

a housing;

a display whose display surface is provided on a front-surface side of the housing;

an image forming unit provided in the housing and configured to form an image on a recording sheet;

an ejector configured to eject the recording sheet with the image formed thereon from inside to outside of the housing in a direction approaching the display surface;

a holder configured to hold the recording sheet ejected by the ejector;

a detector configured to detect whether or not the recording sheet is held by the holder; and a controller configured to, when a time period during which the recording sheet is held by the holder reaches a predetermined time period, display, on the display, a display image indicating that the recording sheet is held, wherein when the ejection of the recording sheet is completed, at least a part of the recording sheet is located along the display surface.

14. The image forming apparatus of claim 13, wherein the ejector is provided below the display surface in a vertical direction, and the direction approaching the display surface is in a range where an inclination angle of the ejected recording sheet against the display surface is at most an inclination angle of the display surface against a vertical plane.

15. The image forming apparatus of claim 13, wherein the controller is further configured to, when the time period during which the recording sheet is held by the holder reaches the predetermined time period, cause the holder to move, and the controller is configured to change a display position of the image in conjunction with a movement of the holder.

16. An image forming apparatus comprising:

a housing;

a display whose display surface is provided on a front-surface side of the housing;

an image forming unit provided in the housing and configured to form an image on a recording sheet;

an ejector configured to eject the recording sheet with the image formed thereon from inside to outside of the housing in a direction approaching the display surface;

a holder configured to hold the recording sheet ejected by the ejector;

a detector configured to detect whether or not the recording sheet is held by the holder; and a prohibiting unit configured to, when the recording sheet is held by the holder, prohibit new formation of an image, wherein when the ejection of the recording sheet is completed, at least a part of the recording sheet is located along the display surface.

17. The image forming apparatus of claim 1, further comprising:

a controller configured to, when the recording sheet is ejected by the ejector, display on the display and within a region of the display facing the recording sheet, an image indicating that the recording sheet is ejected.

18. The image forming apparatus of claim 13, further comprising:

a controller configured to, when the recording sheet is ejected by the ejector, display on the display and within a region of the display facing the recording sheet, an image indicating that the recording sheet is ejected.

19. The image forming apparatus of claim 16, further comprising:

a controller configured to, when the recording sheet is ejected by the ejector, display on the display and within a region of the display facing the recording sheet, an image indicating that the recording sheet is ejected.

* * * * *